US005742932A

United States Patent [19]

Levitsky

[11] Patent Number: 5,742,932

[45] Date of Patent: Apr. 21, 1998

[54] METHOD AND SYSTEM OF ACCOUNTING FOR TRANSACTION COSTS AND CURRENCY EXCHANGE IN A HYBRID MAIL SYSTEM

[75] Inventor: Paul A. Levitsky, Bridgeport, Conn.

[73] Assignee: Pitney Bowes Inc., Stamford, Conn.

[21] Appl. No.: 772,790

[22] Filed: Dec. 24, 1996

[51] Int. Cl.[6] ..... G07B 17/00

[52] U.S. Cl. ..... 705/410; 395/201

[58] Field of Search ..... 364/464.11, 464.14, 364/464.2; 395/201, 216, 235, 239

[56] References Cited

U.S. PATENT DOCUMENTS

| | | | |
|---|---|---|---|
| 4,286,325 | 8/1981 | Dlugos et al. | 364/464.12 |
| 4,677,552 | 6/1987 | Sibley, Jr. | 364/408 |
| 4,694,397 | 9/1987 | Grant et al. | 364/408 |
| 4,766,293 | 8/1988 | Boston | 235/379 |
| 4,926,368 | 5/1990 | Morita et al. | 364/715.05 |
| 5,051,914 | 9/1991 | Sansone et al. | 364/478.11 |
| 5,058,030 | 10/1991 | Schumacher | 364/478.08 |
| 5,060,165 | 10/1991 | Schumacher et al. | 364/478.01 |
| 5,068,797 | 11/1991 | Sansone et al. | 364/478.07 |
| 5,072,401 | 12/1991 | Sansone et al. | 364/478.07 |
| 5,077,665 | 12/1991 | Silverman et al. | 364/408 |
| 5,089,956 | 2/1992 | MacPhail | 395/600 |
| 5,245,545 | 9/1993 | Taylor | 364/478.07 |
| 5,252,811 | 10/1993 | Henochowicz | 235/379 |
| 5,258,908 | 11/1993 | Hartheimer et al. | 364/408 |
| 5,287,270 | 2/1994 | Hardy et al. | 364/408 |
| 5,311,438 | 5/1994 | Sellers et al. | 364/468.02 |
| 5,336,870 | 8/1994 | Hughes et al. | 235/379 |
| 5,377,120 | 12/1994 | Humes et al. | 364/478.12 |
| 5,420,405 | 5/1995 | Chasek | 235/379 |
| 5,426,281 | 6/1995 | Abecassis | 235/379 |
| 5,448,641 | 9/1995 | Pintsov et al. | 380/51 |
| 5,453,601 | 9/1995 | Rosen et al. | 235/379 |
| 5,455,407 | 10/1995 | Rosen | 235/380 |
| 5,459,670 | 10/1995 | Johnson et al. | 364/478 |
| 5,461,667 | 10/1995 | Remillard | 379/96 |
| 5,465,206 | 11/1995 | Hilt et al. | 364/406 |
| 5,473,143 | 12/1995 | Vak et al. | 235/380 |
| 5,477,038 | 12/1995 | Levine et al. | 235/380 |
| 5,496,991 | 3/1996 | Delfer et al. | 235/379 |
| 5,497,317 | 3/1996 | Hawkins et al. | 364/480 |
| 5,517,406 | 5/1996 | Harris et al. | 364/408 |

*Primary Examiner*—Edward R. Cosimano
*Attorney, Agent, or Firm*—Melvin J. Scolnick; David E. Pitchenik; Robert H. Whisker

[57] ABSTRACT

The invention is a method of accounting for a transaction cost and currency exchange relative to customer accounts in a hybrid mail system. The method begins by establishing a data center, a first remote data entry point, and a second remote data entry point which has mailpiece production means. The first remote data entry point, the second remote data entry point, and/or the data center may be co-located. A set of parameters which define a mailpiece, a unit cost where known for each parameter, a destination for the mailpiece, and a choice of debiting or crediting a customer account are determined at the first remote data entry point. The parameters and known costs point are transmitted to the data center and to the second remote data entry point. The mailpiece is produced at the second remote data entry point and a unit cost for each of the mailpiece production and delivery elements is calculated at the second remote data entry point and transmitted to the data center. A total unit cost of the transaction is calculated at the data center and then converted to a transaction cost by multiplying the total unit cost by a currency conversion factor. The transaction cost is then entered into customer account database, a transaction database, and transmitted to the first remote data entry point; additionally, a billing statement is generated by the data center in respect of the transaction and a similar statement can be generated by the first remote data entry point for the benefit of the transaction initiator.

14 Claims, 5 Drawing Sheets

METHOD AND SYSTEM OF ACCOUNTING FOR TRANSACTION COSTS AND CURRENCY EXCHANGE IN A HYBRID MAIL SYSTEM

RELATED APPLICATIONS

Reference is made to application Ser. No. 08/772,798, entitled CHANNEL SWITCHED MAIL MESSAGE SWITCHING AND METERING SYSTEM, assigned to the assignee of this application and filed on even date herewith.

Reference is made to application Ser. No. 08/772,788, entitled A METHOD AND SYSTEM FOR WORLDWIDE MEDIA SELECTION, PRODUCTION AND DELIVERY, assigned to the assignee of this application and filed on even date herewith.

Additionally, reference is made to application Ser. No. 08/722,787, entitled A METHOD AND SYSTEM FOR MAIL PIECE PRODUCTION UTILIZING A DATA CENTER AND INTER-RELATED COMMUNICATION NETWORKS, assigned to the assignee of this application and filed on even date herewith.

BACKGROUND OF THE INVENTION

In recent years, the term "hybrid mail" has grown with increased acceptance as the business and technical communities have found better and more efficient ways to utilize the mail stream not only in the United States, but across the global marketplace as well. Hybrid mail is a creature of the evolution of technology and the mail stream. Where once a mail piece was created locally and then dropped into the closest available mailbox for eventual delivery to a remote location, now the entry points into the mail stream are virtually unlimited.

One of the key elements to the importance of hybrid mail is the ability of the user to get the finished mail piece to its intended destination not just more quickly, but also at a cheaper cost. Additionally, if the mail piece is to cross borders so that two separate currencies are involved in the transaction, there must be a way to efficiently charge a customer in local currency while franking the mail piece in the currency of the remote location; otherwise, the delicate balance of cost, time, and convenience will be upset.

A disadvantage of the prior art is that there has not been an effective marriage of the various art forms required to produce an automated process for causing data processing systems to produce a mail piece from an extensive catalogue of options, transmitting the newly created mail piece to a remote location and then finishing the mail piece remotely while preparing local billing in respect of the service conveyed. Because the prior art does not effectively define hybrid mail, the advantages of local billing within international transactions is not adequately defined.

Art, such as that disclosed in U.S. Pat. No. 5,426,281, issued Jun. 20, 1995 to Abecassis, describe in detail how third parties can provide inexpensive and standardized services that will protect escrowed funds. It should be noted, however, that Abecassis does not anticipate nor describe how funds may be exchanged or escrowed across a breadbasket of currencies while providing easy access to hybrid mail systems.

Hybrid financial services are contemplated by Grant et al. in U.S. Pat. No. 4,694,397, issued Sep. 15, 1987. The hybrid services contemplate providing automatic transaction processing between brokerage and banking accounts. Thus, while combined financial services are possible within a particular account, the disclosure does not anticipate nor describe how funds may be exchanged or escrowed based upon valuations of services or costs occurring in the production of a mailpiece, nor on the ability of a system to produce cross-currency valuations.

Thus, an objective of the present invention is to provide a cost effective means of delivering a finished mail piece to its ultimate destination with the look and feel of a locally assembled product; and, more specifically, to provide a method and means for tracking the costs of services and parameter choices across a spectrum of currencies. The advantage is that the person receiving the mail piece at its final destination will receive a piece that is timely, printed locally in the local language, and flanked locally despite having origins that might be quite remote; and additionally, all parties to the transaction will have accounting that is locally relevant with respect to currency whether at the initiating location, the terminal node, or the data center.

SUMMARY OF THE INVENTION

According to the invention, the object is achieved and the disadvantages of the prior art are overcome by a method of accounting for a transaction cost and currency exchange relative to customer accounts in a hybrid mail system.

The method includes selection, at an initiating location or node which is serving as a first remote data entry point, of a set of parameters which when taken together define a mail piece. The initiating location or node could be a kiosk at a mall or other public forum, a personal computer at home or in the office, or from a storefront retail application. If using a kiosk, the initiating party can use a credit card to initialize the appropriate program. The selection is made by an initiating party initializing a program in a data processing system and then making choices from a series of menus. The choices together define a mail piece which will be produced at a remote location. The initiator determines a destination address for the completed mail piece and then confirms to the data processing system the selected set of parameters and the destination address. The remote location functions as both a second remote data entry point comprising a second data entry program and as site for mail piece production. The initiating party can also enter an account number for debiting the cost of the transaction.

The selected parameters, together with their associated costs, and those costs associated with mail piece production, are transmitted to a data center. The data center will read the destination address, parse the address data, and then determine the most appropriate destination node by comparing elements of the destination address to a list of possible destination nodes that are organized by country, postal code and/or zone. The data center will then transmit the selected parameters and the destination address to the destination node. It is possible for the data center to be co-located with the initiating node; or, for the data center to be co-located with the destination node.

The data center acts as the central repository for all data relating to a transaction, and comprises: a customer account database; a transaction database; a currency exchange database; and, a currency exchange program. The exchange of funds or the charging of an account to pay for services is controlled by recording the franking of the media piece envelope with its proper local currency. If the transaction was initiated in a country different from that of the destination node, then the system will calculate the exchange of local currency at the destination node for the local currency of the initiating node so that the initiating party can be billed in its own local currency. Billing statements for initiators or credit statements for destination nodes originate from the data center.

DETAILED DESCRIPTION OF THE PREFERRED EMBODIMENTS

Figure 1:
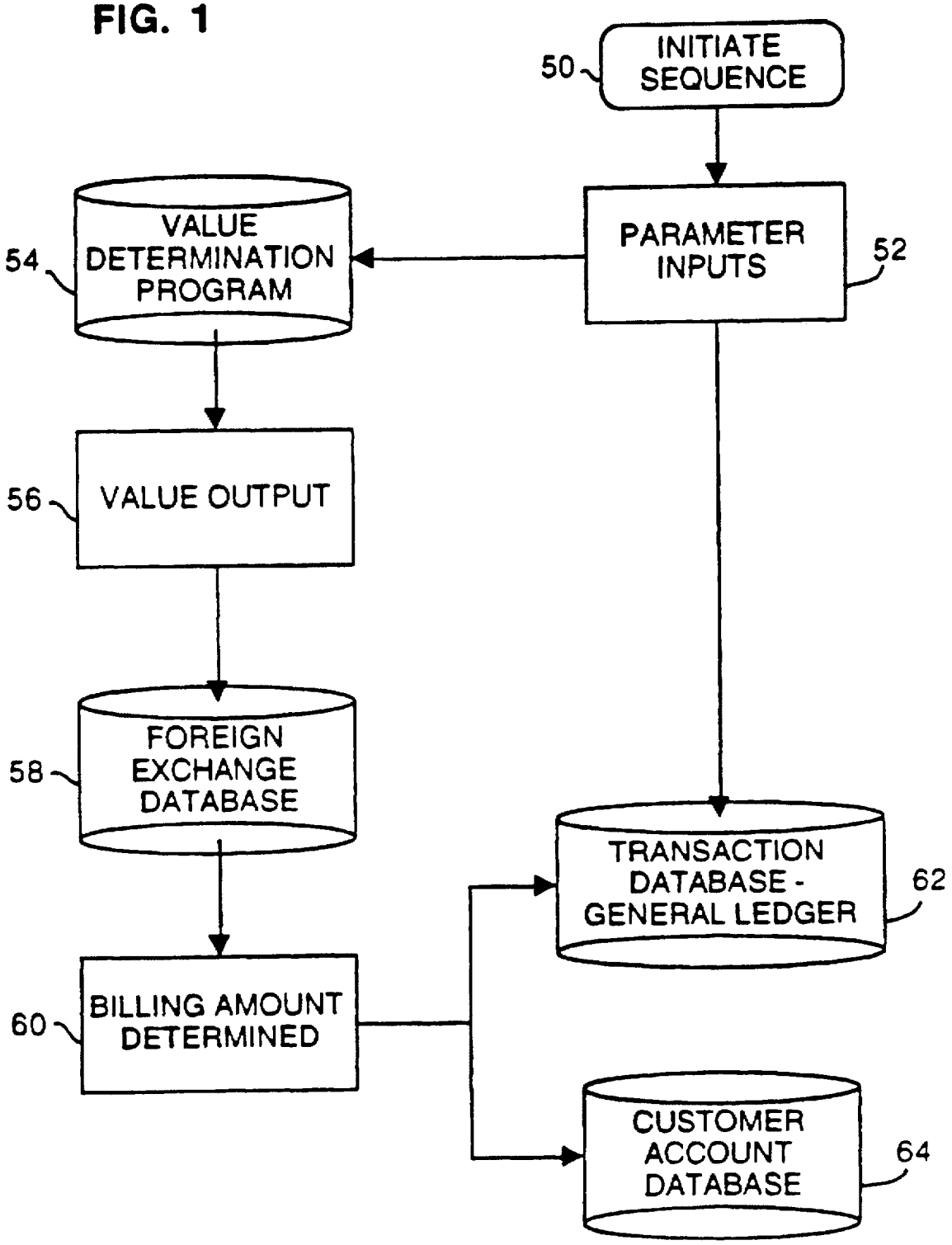
FIG. 1 is a high level flowchart of the method of accounting for a transaction cost and currency exchange relative to customer accounts in a hybrid mail system.

Turning to FIG. 1, there is shown a top level flowchart of the system method. The application is initiated at step 50. Entry into the system application can be effected from any of several initiating locations such as a home personal computer (PC), a retail counter operation, or a mall kiosk (hereinafter "initiating points"). If entry is effected from a home PC, then it is anticipated that the home PC would only be acting as an entry point into the system and not as a destination node because of the limited media capability. It should be noted, however, that an upgrade capability for the home PC is both possible and desirable for those cases where capability expansion is required such as when a home PC is used within a home-based business venture. The retail counter operation is representative of a distribution system that would anticipate both an initiating point and a destination node. A mall kiosk, which is similar to the well known bank ATMs, allows walk-through traffic in public areas to access the system as an initiating point.

The initiating points determine, at step 52, the parameters of the mail piece to be created at the destination node. The destination node is the location at which the mail piece will be created. The method advances from the initiating points to a value determination program at step 54 where the mail piece parameters ("hereinafter "data") are downloaded to a national or regional data center. In addition the costs associated with production are obtained from the destination node, that will produce the mailpiece. The data center acts as a hub for the receiving of mail piece data and determines at step 56 what the value of the transaction will be. From step 56, the method advances to a foreign exchange database at step 58.

At step 58 the method takes the transaction parameter values, together with the production costs, and compares the costs in the currency in which the costs were reported to the data center against a currency in a foreign exchange database required for billing purposes. The method then advances to step 60 where the system determines a value for billing purposes. Once a billing value has been determined, the value is simultaneously recorded in both a transaction database general ledger account at step 62 and in a customer account database in step 64.

Returning to step 52, the parameter inputs that are passed on to the value determination program of step 54 are simultaneously passed on to the transaction database general ledger of step 62 for record retention.

Figure 2A:
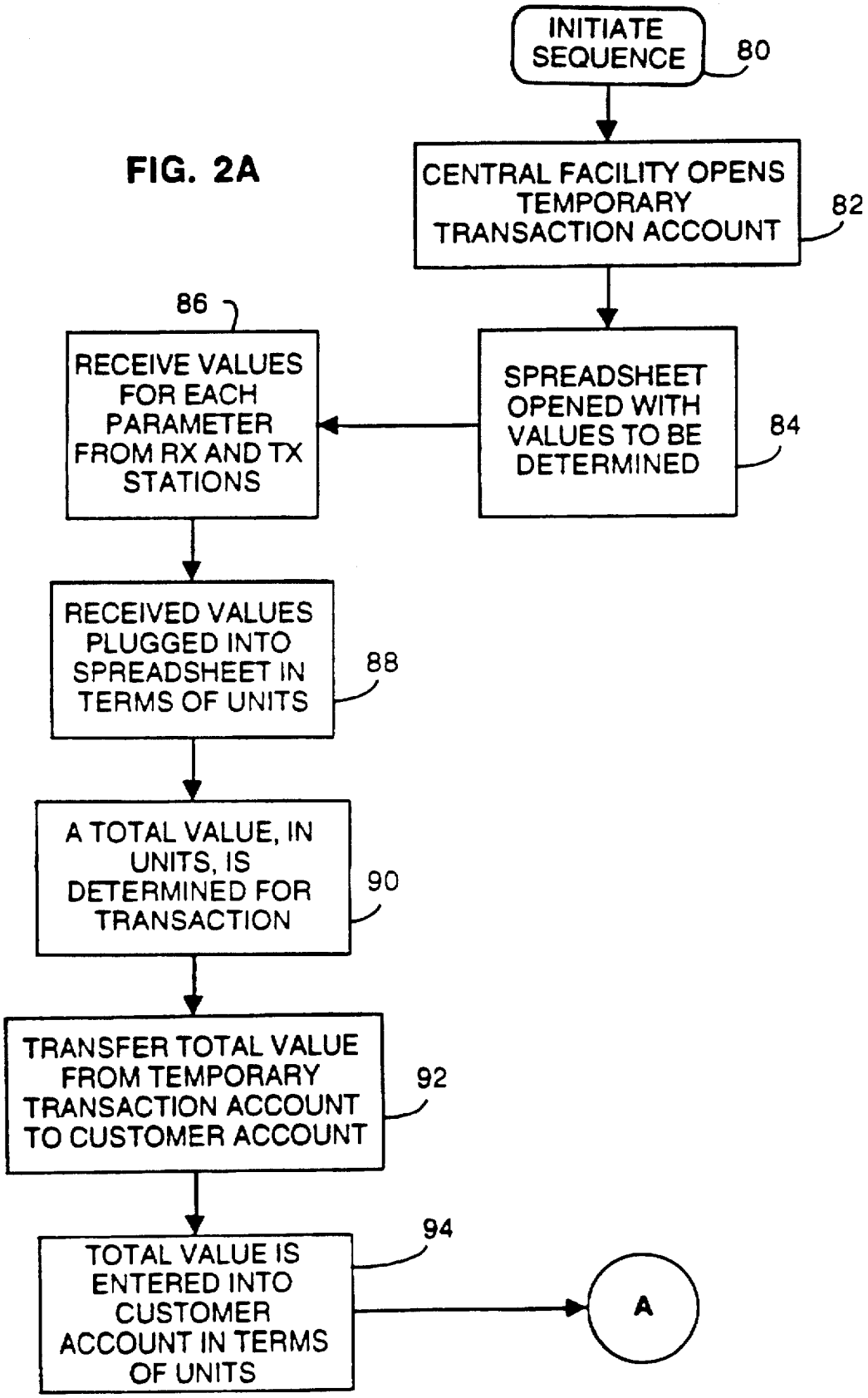
FIGS. 2A through 2C representative a detailed flowchart of the method of accounting for transaction costs.
Figure 2B:
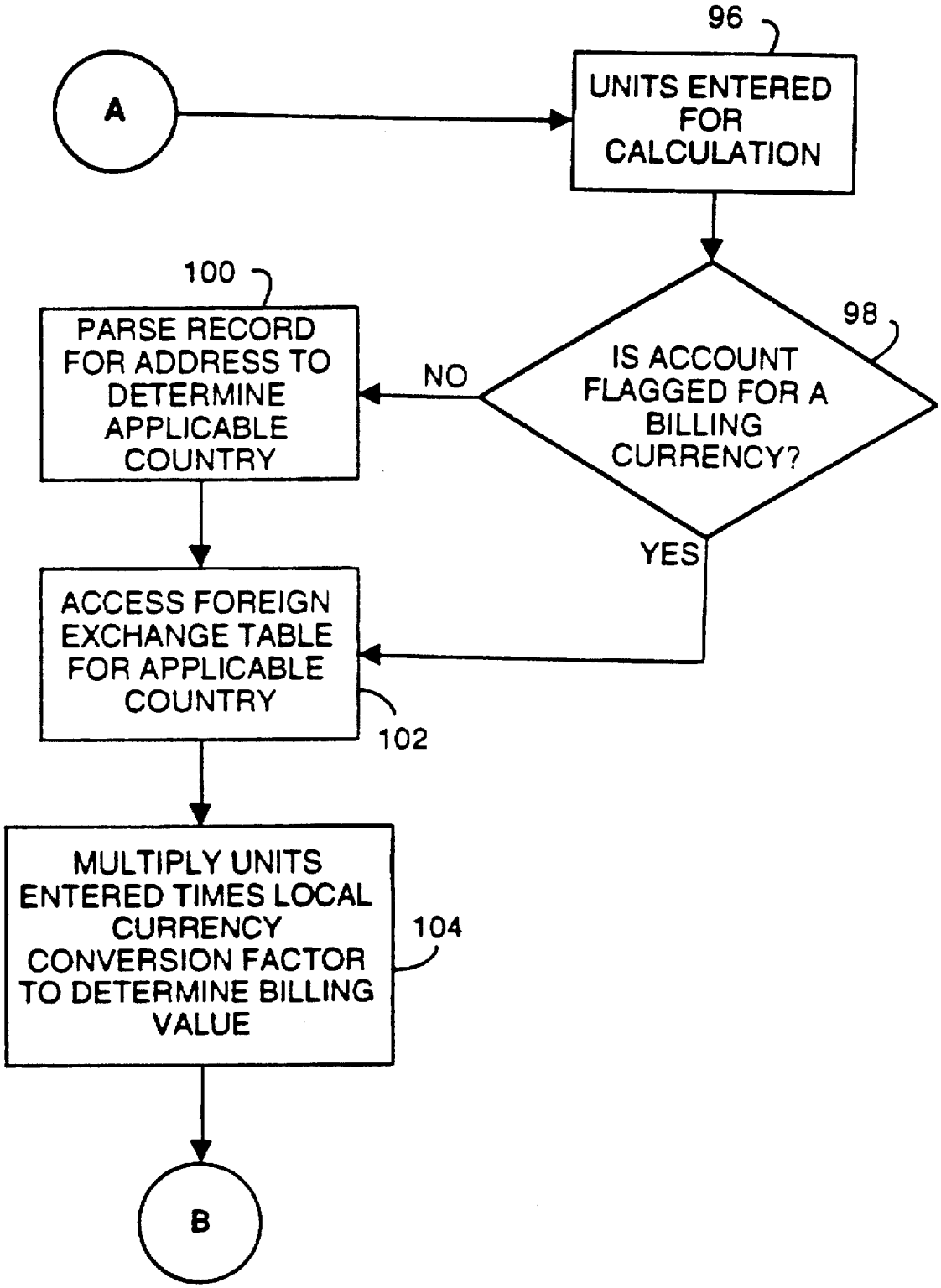
Figure 2C:
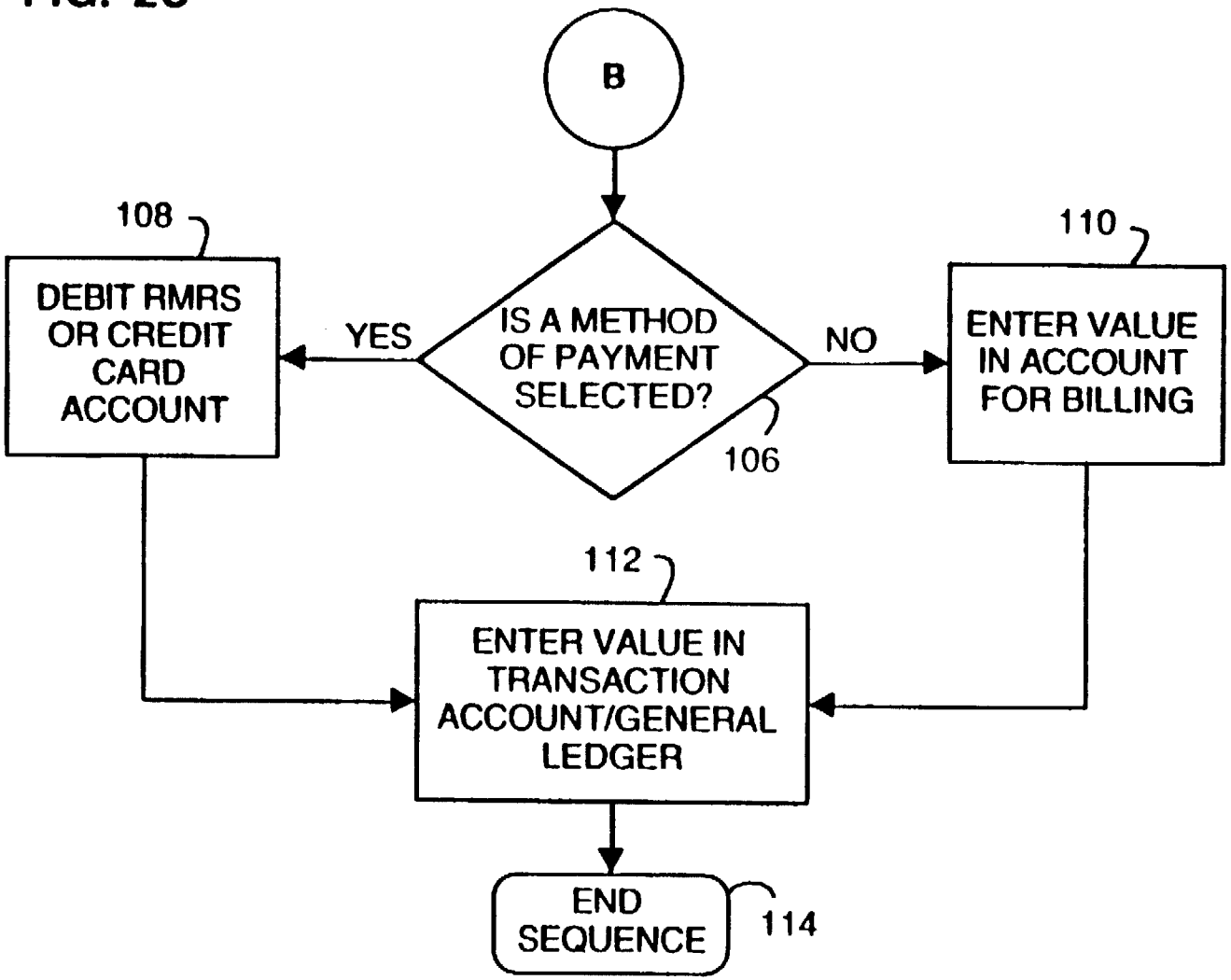

FIGS. 2A through 2C more clearly define the valuation and currency exchange process at the data center. Turning to FIG. 2A, the method flow is initiated at step 80 and advances to step 82 where the data center opens a temporary transaction account; or, if a series of data centers is used, then a central facility can be designated which maintains the account databases. The temporary transaction account is comprised of a series of spreadsheets which are opened at step 84. The spreadsheets will be assigned a set of values at step 86 from which total values can be calculated and prepared for billing or statement purposes. Values are received at the data center from both the transmitting (initiating) station and the destination node that will be producing the finished mailpiece. The values from the transmitting station represent costs for certain parameters of the mailpiece production that are determined by the transaction initiator. The values received from the receiving (mailpiece production site) node are generally representative of postage or special costs.

As the values are received, they are assigned to an appropriate spread sheet at the data center by giving the value a unit value by translating the received currency value to a uniform currency unit (UCU) at step 88. At step 90, a total value in UCUs is determined for a particular transaction and then the total UCU value of the transaction is transferred from the temporary account to the customer database at step 92 and the total value in UCUs is entered into the customer account at step 94.

From step 94, the method advances along path A to re-enter the method flow at step 96 as shown in FIG. 2B.

At step 96, the total uniform currency units is entered into the currency exchange application for a calculation of the value of the UCUs in local currency. Local is defined as that currency utilized by the party in interest; that is, if the value is being determined for customer account billing, then local currency is that currency represented by the customer's physical location or billing address. The method advances to a query at step 98 which asks whether or not the customer account is flagged for a particular currency. If the response to the query is "YES," then the method advances to step 102 where the system accesses a foreign exchange table for the country or currency applicable to the specific customer. If, however, the response to the query is "NO," then the system will advance to step 100 and parse the customer account data to determine an applicable country before advancing to step 102.

From step 102, the method advances to step 104 where the system will multiply the uniform currency units for the transaction by the local currency conversion factor to determine a local currency value for customer billing purposes. The method advances from step 104 along path B to step 106 as shown in FIG. 2C.

Turning to FIG. 2C, there is shown a query at step 106 which asks if a method of payment has been selected and entered within the customer account data. If the response to the query is "YES," then the method advances to step 108 where a credit card account is debited; a cash transaction is recorded; or alternatively, a postage value account (RMRS account), or similar account is utilized from which a value can be deducted. The method advances from step 108 to step 112 where the deducted value is entered into a transaction account general ledger. Returning to step 106, if the response to the query is "NO," then the method advances to step 110 where the transaction value is entered into the customer account for billing. The method advances from step 110 to step 112 where the "to be billed" value is entered into a transaction account general ledger. The method then advances to step 114 where the individual transaction sequence is ended.

Figure 3:
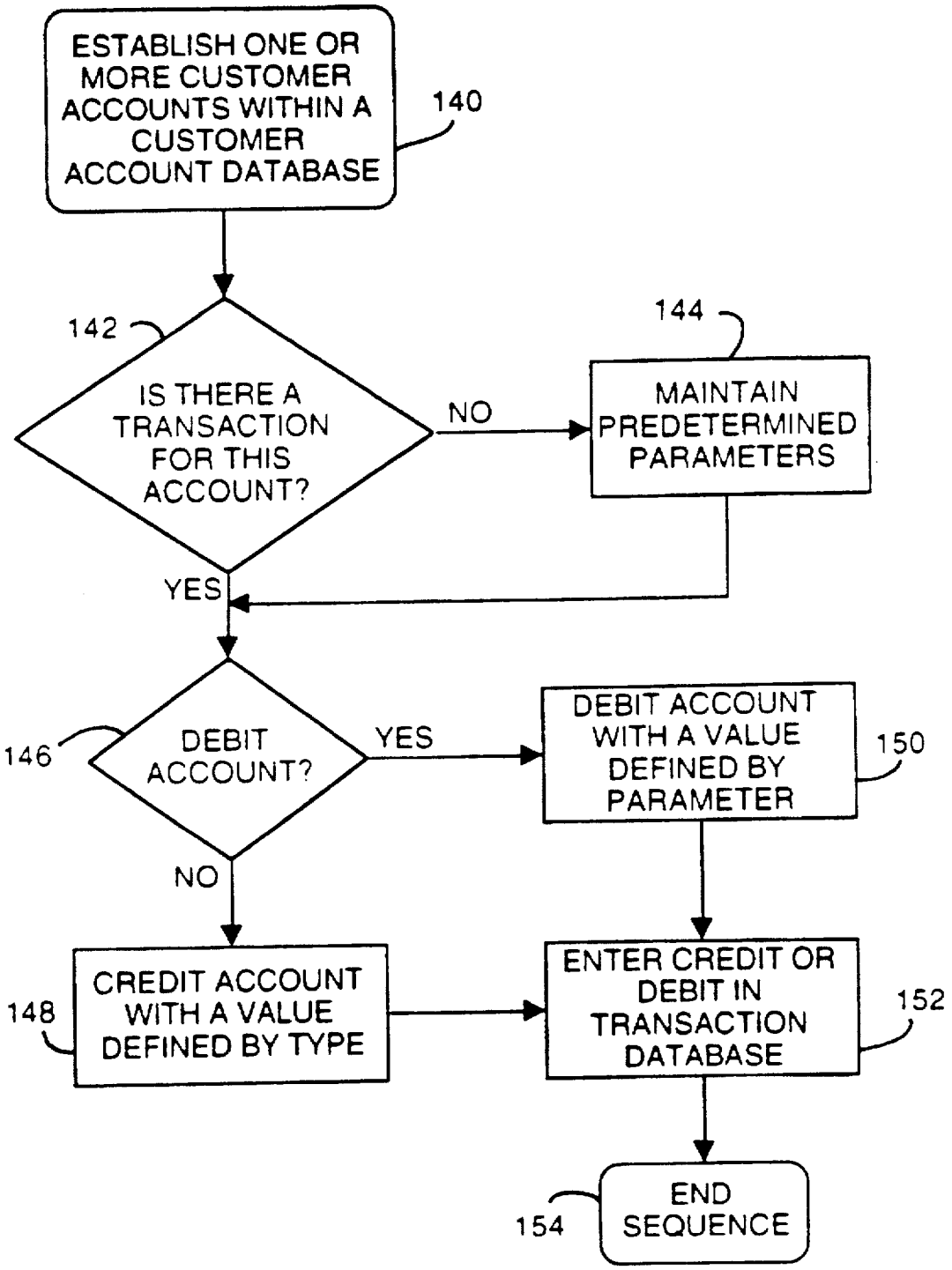
FIG. 3 is a flowchart of how the transaction cost is allocated to a particular customer account.

The customer account decision flow is more clearly illustrated in FIG. 3. Turning to FIG. 3, at step 140, one or more customer accounts are established within the customer account database. Once established, the system advances to a query at step 142 which asks if there is a transaction for each of the individually established customer accounts. If the response to the query is "NO," then at step 144 the system simply maintains the status quo by maintaining predetermined parameters of each account. From step 144, the method advances to re-enter the flow at step 146. If the response to the query at step 142 is "YES," however, then method advances directly to step 146.

Step 146 is a query which asks if the customer account is to be debited. If the response to the query is "YES," then the account is debited with a value that is defined by a mailpiece production parameter at step 150. Mailpiece production parameters include, but are not limited to: selection or creation of text; media stock selected; delivery services selected; text translation; or transmission charges. From step 150 the method advances to step 152. If the response to the query at step 146 is "NO," then the system credits the customer account with a value that is defined by type at step 148. Transaction types include, but are not limited to: periodic payments; transaction payments; or advance payments. From step 148, the method advances to step 152. At step 152, the credit determined at step 148, or the debit determined at step 150, is entered into the transaction database before advancing to step 154 where the entry sequence is A1 ended.

As can be appreciated by those skilled in the art, a number of variations of the subject invention are possible. These variations include, but are not limited to: the breadbasket of currencies utilized within the foreign exchange database; the variations in systems configuration at the node producing the mailpiece; the method of communications between the initiating node, destination node, and data center; and, the range of services available at the production facility and during the establishment of the mailpiece production parameters.

It is to be, understood that the present invention is not to be considered as limited to the specific embodiment described above and shown in the accompanying drawings, which merely illustrates the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

What is claimed is:

1. A method of accounting for a transaction cost and currency exchange relative to a customer accounts in a hybrid mail system, comprising the steps of:

(a) establishing a data center;

(b) establishing a first remote data entry point comprising a first data entry program;

(c) establishing a second remote data entry point comprising a second data entry program and a mail piece production means;

(d) selecting, in said first data entry program, a set of parameters and a unit cost for each parameter of said set of parameters which together define a mailpiece, a destination for said mailpiece wherein said destination is designated as said second remote data entry point, and a choice of debiting or crediting a customer account wherein said account is maintained at said data center;

(e) transmitting said set of selected parameters, and a unit cost associated with a predetermined subset of parameters wherein said predetermined subset comprises costs known to said first remote data entry point, to said data center and to said second remote data entry point;

(f) producing said mailpiece at said second remote data entry point wherein said mailpiece is comprised of a first set of elements determined by said selected set of parameters;

(g) calculating, at said second remote data entry point, an unit cost for each of said mailpiece production and delivery elements;

(h) transmitting said calculated unit cost from said second remote data entry point to said data center;

(I) calculating, at said data center, a total unit cost of said transaction;

(j) converting said total unit cost to a transaction cost by multiplying said total unit cost by a currency conversion factor and wherein said factor is selected from a set of factors predetermined by currency type;

(k) transmitting said transaction cost to said customer account database, to said transaction database, and to said first remote data entry point; and (l) accounting for said transaction cost by storing said transaction cost in said customer account database, said transaction database and at said first remote data entry point for use in accounting records.

2. The method of claim 1, wherein said data center further comprises:

(a) a customer account database;

(b) a transaction database;

(c) a currency exchange database; and (d) a currency exchange program.

3. The method of claim 1, wherein payment is made to said second remote data entry point by said data center as pre-determined by a second set of elements comprising costs of said production and delivery of said produced mailpiece wherein said costs were incurred at said second remote data entry point.

4. The method of claim 1, wherein said currency type is determined by selecting a currency type corresponding to a local currency as based upon the physical address of said first remote data entry point.

5. The method of claim 1, wherein a billing statement is generated by said data center in respect of said transaction.

6. The method of claim 1, wherein a billing statement is generated by said first remote data entry point in respect of said transaction.

7. The method of claim 1, wherein said first remote data entry point and said second remote data entry point are co-located.

8. The method of claim 1, wherein said first remote data entry point and said data center are co-located.

9. The method of claim 1, wherein said second remote data entry point and said data center are co-located.

10. The method of claim 1, wherein said first remote data entry point, said second remote data entry point, and said data center are co-located.

11. A system of accounting for a transaction cost and a currency exchange relative to a customer account in a hybrid mail system, comprising:

(a) first data entry means, located at an initiating location, for entering a set of parameters which together form a mailpiece, and a unit cost for each parameter of said set of parameters;

(b) first transmission means for transmitting data from said first data entry means to second data entry means for processing said set of parameters transmitted from said first data entry means;

(c) second transmission means for transmitting data comprising production costs from said second data entry means to a data center;

(d) value determination means located at said initiating location, at the location of said data entry means, and at said data center for determining an individual value for each of said parameters, said individual value being determined in a currency associated with a particular location;

(e) calculator means for calculating said transaction cost based upon a sum of said individual values;

(f) table look-up means for comparing said transaction cost in said currency with a corresponding value in another currency as listed in a currency database; and (g) billing means for billing a customer in respect of said other currency corresponding value as charged against said customer account.

12. The system of claim 11, wherein said customer is an initiator of said transaction.

13. The system of claim 11, wherein said particular location corresponds to said initiating location.

14. The system of claim 11, wherein said particular location corresponds to a location of said second data entry means.

* * * * *